US005254366A

United States Patent [19]

Lowther

[11] Patent Number: 5,254,366

[45] Date of Patent: Oct. 19, 1993

[54] METHOD OF TREATING TUBULARS WITH UNGELLED GELATIN

[75] Inventor: Frank E. Lowther, Plano, Tex.

[73] Assignee: Atlantic Richfield Company, Los Angeles, Calif.

[21] Appl. No.: 864,280

[22] Filed: Apr. 6, 1992

[51] Int. Cl.[5] ..... B05D 7/22

[52] U.S. Cl. ..... 427/238; 427/239

[58] Field of Search ..... 427/238, 239, 230

[56] References Cited

U.S. PATENT DOCUMENTS 2,795,278 6/1957 Battle .
3,220,874 11/1965 Poettmann .
3,855,137 12/1974 Whitney .
3,863,717 2/1975 Cooper .
4,003,393 1/1977 Jarrard et al. .
4,254,559 3/1981 Purinton .
4,687,595 8/1987 Howes et al. .
5,020,561 6/1991 Li .

FOREIGN PATENT DOCUMENTS 957910 11/1974 Canada .

OTHER PUBLICATIONS

Encylopedia of Chemical Technology, Kirk-Othmer, Third Edition, vol. 11, J. Wiley & Sons, N.Y. pp. 711-715 and 911-920.

Pipeline Pigging Technology, J. N. H. Tiratsoo, Gulf Publishing Co. Houston, Tex., May, 1989, pp. 139-157.

*Primary Examiner*—Bernard Pianalto
*Attorney, Agent, or Firm*—Drude Faulconer

[57] ABSTRACT

A method for treating tubulars, e.g. a pipeline, wherein an ungelled gelatin solution is mixed with fluids flowing through the tubular to deposit a treatment layer onto the wall of the tubular. The ungelled gelatin is injected into the flowing fluids at a temperature which is at or above the temperature of the fluids in the pipeline. This keeps the gelatin solution liquid (i.e. ungelled) even after mixing with the fluids. Gelatin derived from collagen is mixed with a liquid (e.g water) and heated. A separate treating solution (e.g. anti-freeze, corrosion inhibitor, and/or a drag reducer) can be added into the ungelled gelatin solution as it is mixed. The concentration of gelatin in the solution concentration of gelatin in said ungelled solution is the maximum amount which will allow the solution to remain ungelled at said the temperature of the flowing fluids.

9 Claims, 2 Drawing Sheets

METHOD OF TREATING TUBULARS WITH UNGELLED GELATIN

DESCRIPTION

1. Technical Field

The present invention relates to a method of treating tubulars with ungelled gelatin and in one of its aspects relates to a method of treating a tubular wherein an ungelled gelatin solution is mixed with fluids flowing in a tubular to deposit a treatment layer onto the wall of the tubular.

2. Background Art

Most tubulars, e.g. pipelines, must be treated periodically to extend their operational life and/or to improve and maintain their operating efficiencies. For example, pipelines used for transporting crude oil and/or natural gas which contain even small amounts of water routinely experience severe corrosion problems which, if not timely treated, can result in early failure of the line. Also, the interior surfaces or walls of the pipes have a substantial "roughness" even when new which increases with scaling, pitting, etc. during operation. As this roughness increases, the friction or "drag" between the pipe wall and the fluids flowing therethrough substantially increases thereby substantially reducing the flowrate through the pipeline.

In most known corrosion and drag reduction treatments of tubulars, a layer or film of an appropriate treating solution, i.e corrosion inhibitor or drag reducer, is deposited onto the interior surface or wall of the pipeline. In corrosion treatment, the film of corrosion inhibitor protects the pipe wall from contact with water or other electrolytes or oxidizing agents while in drag reduction, the film of drag reducer fills in the pits, etc. in the pipe wall to smooth out the wall surface to thereby reduce the friction between the flowing fluids and the pipe wall. In still other instances, the pipeline may be treated for other problems, e.g. bacteria buildup, etc. wherein different treating solutions may be used, e.g. biocides, herbicides, etc.

There have been several techniques proposed for providing a film of treating solution onto the wall of a tubular. For example, probably the most commonly-used technique is to merely add the treating solution to the fluids flowing through the pipeline and/or periodically flowing a slug of the liquid treating solution through the line. Due to the properties of treating solution, it migrates outward against the pipe wall and adheres thereto; hopefully forming a relatively uniform layer or thin film on the entire surface of the wall. Of course, insuring that a uniform layer of solution will actually be deposited onto the wall of a pipeline through which fluids are flowing is extremely difficult, if possible at all. Further, the amount of treating solution that must be added to the flowing fluids is several magnitudes greater than is required to form the thin layer on the pipe wall so large volumes of solution are wasted.

Still further, some of the better-known and more successful treating solutions (e.g. polyethylene oxide) have very high viscosities when in a liquid solution. These high viscosities require sophisticated pumping systems for injecting these treating solutions into fluids flowing through a tubular and severely restricts the rate at which the treating solution can be added to the fluids.

Other techniques for treating tubulars involve flowing slugs of treating solution through a line between structural or mechanical "pigs" (i.e. members that move free in the pipeline and act as pistons) or dispensing the solution directly onto the wall from specially-designed pigs. In addition to the costs involved in the use of excess solution and the difficulty of negotiating the mechanical pig through the line, special pig "launchers" and "catchers" have to be built and installed into the pipeline which adds substantially to the cost and handling problems.

One more recently developed technique for treating tubulars overcomes many of the drawbacks associated with the above-discussed prior art methods and involves the uses of a "gelled" pig or pigs. An example of an early gelled pig is one which was formed by gelling a liquid hydrocarbon with a gelling agent, e.g. alkyl orthophosphate ester, and an activator, e.g. sodium aluminate, and may also contain a corrosion inhibitor, see Canadian Patent 957,910. More recent gelled pigs have been comprised of technical gelatin which is derived from collagen and which is believed to have several advantages over previously, known gelled pigs. For a more complete description of "gelatin" pigs, see co-pending U.S. patent application Ser. Nos. 07/683,164, filed Apr. 10, 1991; 07/697,543, filed May 9, 1991; 07/705,456, filed May 24, 1991; and 07/732,013, filed Jul. 18, 1991; all commonly assigned to the present assignee.

While gelled pigs offer many advantages in the treatment of tubulars, e.g. pipelines, there are still instances where their use may present problems. That is, if the pig is gelled externally and then inserted into the pipeline, appropriate structure must be welded or otherwised installed into the pipeline for inserting the gelled pig into the line. While not as expensive as a mechanical pig launcher, this still adds considerably to the time and expense of preparing the line for treatment with the pig. If the pig is to be gelled in situ within the tubular, the flow of fluids through the pipeline must be stopped while the ungelled slug of material is inserted into the pipeline and allowed to gel. This can be both time consuming and costly since the pipeline can carry no fluids during this time.

SUMMARY OF THE INVENTION

The present invention provides a method for treating tubulars, e.g. a pipeline, wherein an ungelled gelatin solution is mixed with fluids flowing through the tubular and is carried thereby to deposit a treatment film or layer onto the wall of the tubular. The ungelled solution of gelatin is mixed with the fluids much in the same manner as are conventional inhibitors/reducers in known, prior art treatments. That is, the ungelled gelatin is injected into and mixed with the flowing fluids at a temperature which is at or above the temperature of the fluids in the pipeline. This prevents the gelatin solution from cooling to its gel temperature thereby keeping the gelatin basically liquid (i.e. ungelled) as it is carried in the fluids through the pipeline. The ungelled gelatin is then deposited onto the wall of the tubular in the same manner as are conventional treating agents in known prior art treatments.

"Gelatin" as used herein is technical gelatin derived from collagen and is of the type used in foods, glues, and the like. The gelatin is mixed with a liquid and heated. Preferably, the gelatin is mixed with water and is heated to about 170° F. If mixed in a frigid environment, an anti-freeze material, e.g. methanol, may be added to keep the water from freezing. In some instances, the gelatin, itself, will act as a treating agent, but if desired, a separate treating solution (e.g. a corrosion inhibitor and/or a drag reducer) may be incorporated into the ungelled gelatin solution as it is being mixed.

The amount or concentration of the technical gelatin in any particular ungelled solution will depend primarily on the line temperature of the pipeline to be treated, i.e. the temperature of the fluids flowing through the pipeline. In the present invention, the line temperature will be above the gelling temperature of the gelatin solution (typically around 100° F.). This keeps the gelatin in an ungelled state even after the solution has been mixed with the flowing fluids. The solution can be mixed with the fluids by merely pumping the solution directly into the pipeline through a simple inlet in the line. The solution mixes with the flowing fluids and is carried thereby through the pipeline. The ungelled gelatin and any treating solution therein migrate outward to the wall of the pipeline to form a treatment layer thereon.

BRIEF DESCRIPTION OF THE DRAWINGS

The actual construction, operation, and apparent advantages of the present invention will be better understood by referring to the drawings in which like numerals refer to like parts and in which.

BEST KNOWN MODE FOR CARRYING OUT INVENTION

In accordance with the present invention, a method is provided for treating a tubular wherein an ungelled gelatin solution is mixed with fluids flowing through the tubular whereby the gelatin is carried by the fluids through the tubular to deposit a treatment film or layer onto the tubular wall. As used herein, "tubular" is intended to include any pipe or conduit (i.e. pipelines) through which fluids (i.e. liquids and gases) and solids (i.e. particulates) are flowed.

The ungelled solution of gelatin is mixed with the fluids flowing through a tubular, e.g. pipeline, much in the same manner as conventional inhibitors/reducers were mixed with the flowing fluids in similar prior art treatments. That is, the ungelled gelatin is injected into and mixed with the flowing fluids at a temperature which is at or above the temperature of the fluids in the pipeline which, in turn, is above the gelling temperature of the gelatin solution. This causes the gelatin solution to remain substantially liquid (i.e. ungelled) during and after mixing with the fluids. The ungelled gelatin is carried through the tubular by the flowing fluids and is deposited onto the wall of the tubular in the same manner as were the conventional treating agents of the known prior art treatments. However, as will be discussed below, gelatin appears to have certain advantages over the previously known treating agents.

In many known prior art inhibitor/reducer treatments, a liquid solution of a treating agent is injected directly into the fluids flowing through a pipeline. These treating agents, which must be injected in excess amounts to insure an adequate film will be formed on the tubular wall, are very expensive. Further, the individual molecules of many conventional agents are spherical which, in turn, have low molecular weights, i.e. in the range of a few hundred. From FIG. 1 it can be seen that the length of a spherical molecule remains relatively short even as it molecular weight substantially increases. Since a spherical molecule 10 is short in length, (e.g. a few microinches) it is theorized that the molecule can only attach itself onto a pipewall 11 at a single atomic site 12 (see FIG. 2). This requires a large number of molecules to provide a uniform layer on the wall with little or no overlap between molecules.

Figure 3:
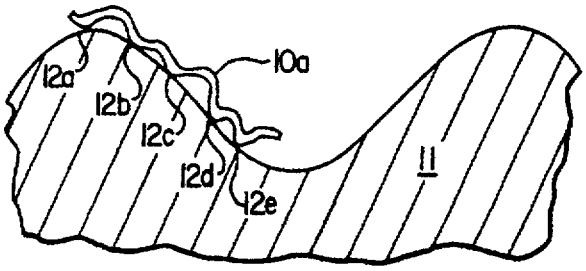
FIG. 3 is an idealized representation of a pipe wall onto which a treated solution formed of elongated molecule has adhered.

Still other well known, conventional agents are formed of linear molecules. Again referring to FIG. 1, it can be seen that the length of a linear molecule increases substantially with its molecular weight. Examples of such commonly-used agents are linear polymers (e.g. polyethylene oxide) which have linear molecules of molecular weights in the 100,000–2,000,000 range. The ability of achieving good effects with linear polymers seems to depend on being able to "stretch out" or elongate the relatively long, molecules after the molecules have been mixed with the flowing fluids. By stretching out the molecules, each elongated molecule 10*a* can attach itself to the pipewall 11 at more than one atomic site 12*a*–12*e* (FIG. 3) thereby providing a better bond therewith.

It has been determined that for the linear molecules of polyethylene oxide and like compounds to be stretched out, they must be subjected to high strain rates (i.e. turbulent flow) after they have mixed with the fluids flowing through the pipeline. The molecules as they elongate, align in the direction of the principal strain rate, resulting in large extensions of the molecules, thereby permitting the molecules to attach to the pipe wall at more than one site as mentioned above.

Unfortunately, as the concentration of a linear polymer increases in a solution, the viscosity of the resulting solution also increases substantially to a point where it becomes difficult to pump the solution into the pipeline at the rates necessary to achieve the desired turbulent flow without employing sophisticated and expensive pumping systems.

Now again referring to the present invention, a solution of ungelled gelatin is used as the primary treating agent in the treatment similar to that which previously utilized an agent having linear molecules. As is well known and as used herein, "gelatins" is a term of art which specifically refers to highly-branched, high molecular weight polypeptides derived from collagen which, in turn, is the primary protein component of animal connective tissue (e.g. bones, skin, hides, tendons, etc.). Gelatin—sometimes specifically referred to as "technical gelatin" and commonly used in foods (highly refined), glues (lesser refined), photographic and other products—does not exist in nature but is a hydrolysis product obtained by hot water extraction from the collageous raw material after it has been processed with acid, alkaline, or lime. The viscosity of aqueous gelatin solutions increases with increasing concentrations and decreasing temperatures. For a more complete description and discussion of gelatin, its compositions and properties, see ENCYCLOPEDIA OF CHEMICAL TECHNOLOGY, Kirk-Othmer, 3rd Edition, Vol. 11, J. Wiley & Sons, N.Y., pps. 711 et sec.

Figure 1:
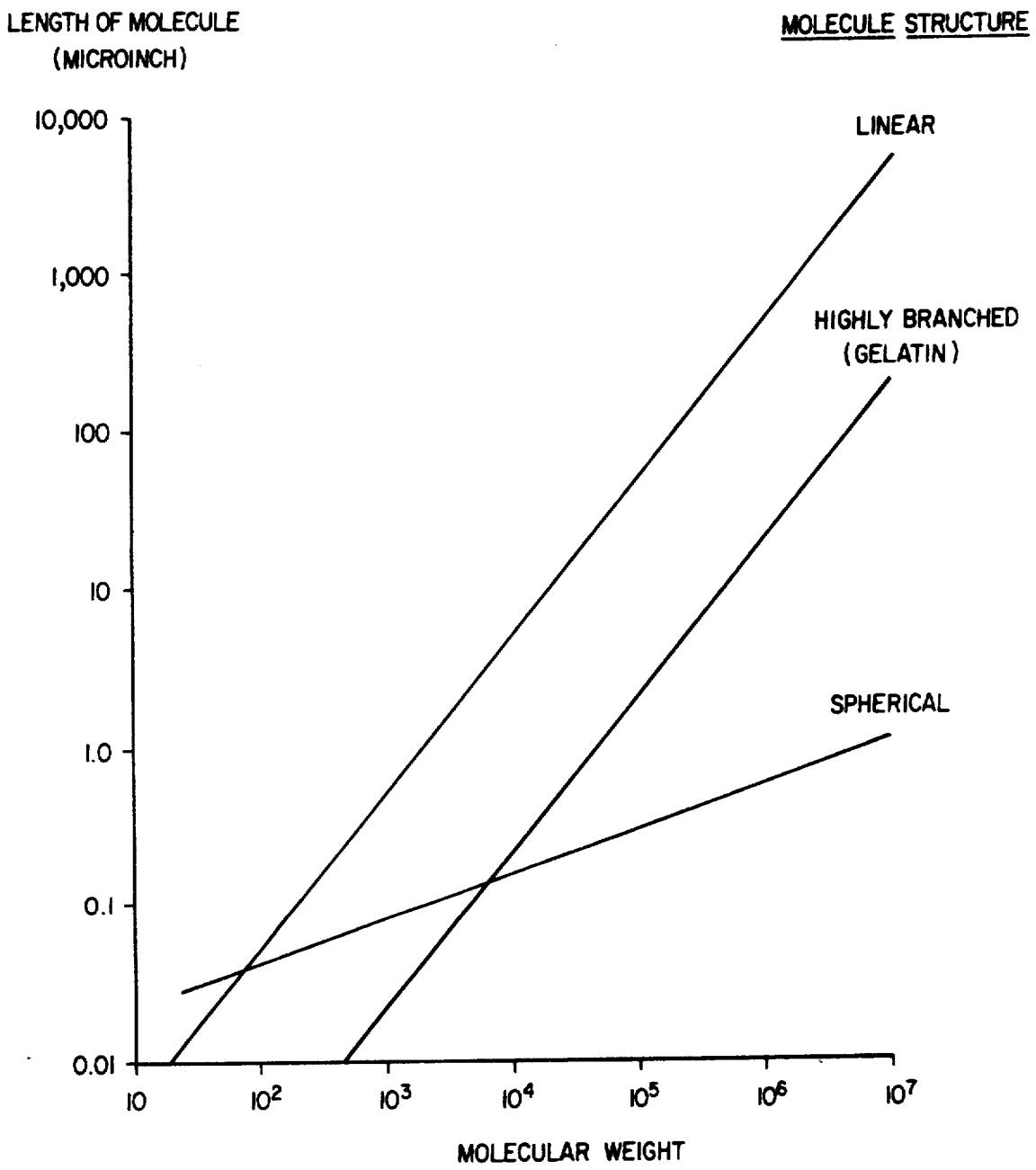
FIG. 1 is a graph correlating the molecular weight of spherical, highly-branched, and linear molecules of typical treating agents with the lengths of the respective molecules.
Figure 2:
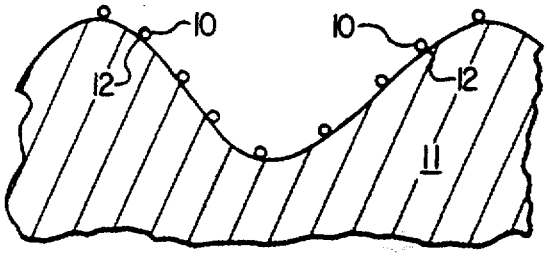
FIG. 2 is an idealized representation of a pipe wall onto which a treating agent formed of spherical modecules has adhered.

Technical gelatin has highly-branched molecules, the length of which increase substantially as its molecular weight increases (see FIG. 1). While the molecular weight of technical gelatin is similar to that of the linear polymers (e.g. 100,000 to 2,000,000), the relative long molecules of gelatin are "stretched" or elongated by simply heating and do not require the high strain rates (i.e. turbulent flow) needed to stretch the molecules of the linear polymers. Accordingly, in addition to being much less expensive than linear polymers, solutions having high concentrations of gelatin can be maintained as a liquid with resulting lower viscosities merely by heating the solution to a temperature in excess of the gelling temperature of the solution. This simplify the pumping of the solution into the pipeline and can be done with standard type pumps.

The technical gelatin (i.e. gelatin derived from collagen) is mixed with a liquid and heated. Technical gelatin will form a solution with almost any liquid except raw pineapple juice, and is relatively independent of the actual liquid, itself. Preferably, the gelatin is mixed with water and heated to about 170° F. or above to form the gelatin solution used in the present treatment. If mixed in a frigid environment, an anti-freeze material, e.g. methanol, may be added to keep the water from freezing. In some instances, the gelatin, itself, may act as a treating agent, (e.g. as a corrosion inhibitor and/or a drag reducer) but if desired, a separate treating solution may be incorporated into the ungelled gelatin solution as it is formed.

If the treatment of a tubular is primarily to inhibit corrosion, the added treating solution may be selected from known corrosion inhibitor of the type used to treat tubulars. Examples of good corrosion inhibitors are (1) an aqueous blend of fatty acid imidazoline quaternary compound and alcohol, e.g. commercially-available as NALCO 3554 INHIBITOR; (2) an alkylamide polyamide fatty acid sulfonic acid salt in a hydrocarbon solvent, e.g. VISCO 945 CORROSION INHIBITOR; (3) an imidazoline fatty acid, e.g. OFC C-2364 CORROSION INHIBITOR. For examples of other corrosion inhibitors, see U.S. Pat. No. 5,020,561, issued Jun. 4, 1991.

If the treatment of a tubular is primarily to reduce drag, any known drag reducer of the type used to reduce drag in tubulars may be incorporated into the gelatin solution. For example, many of the above-identified corrosion inhibitors are also good drag reducers thereby producing the combined benefits of reducing drag and inhibiting corrosion. Also, high molecular weight (e.g. $10^6$) homopolymers, e.g. polyethylene oxide, are good drag reducers in that the high weight molecules at least partially "fill" any indentations in the pipewall to "smooth" out the roughness of the wall thereby reducing drag between the pipewall and the flowing fluids. Other treating solutions such as biocides, herbicides, etc. can be incorporated into the ablating gelatin pig if desired for a particular treatment.

The actual amount or concentration of the technical gelatin (e.g. from about 30% to about 90% by weight) in any particular ungelled solution will depend primarily on the line temperature of the pipeline to be treated, i.e. the temperature of the fluids flowing through the pipeline. For the present invention to operate effectively, the line temperature is above the gelling temperature of the gelatin solution (typically around 100° F.) so that the solution will not gel in the pipeline during or after it is injected therein. In most hydrocarbon pipelines, even in the Arctic, the line temperatures are all above the gelling temperature and are typically substantially higher, e.g. 180° F.

Figure 4:
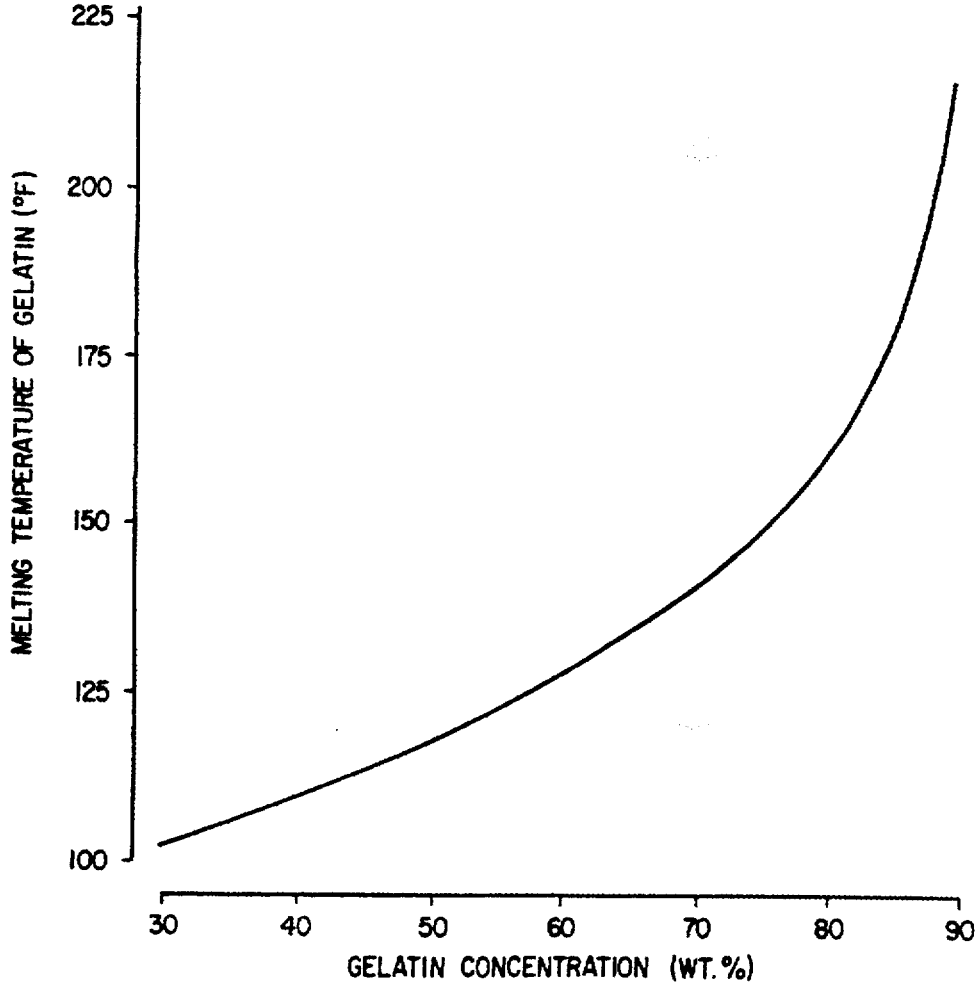
FIG. 4 is a graph correlating the concentration of technical gelatin with its respective melting temperatures.

Generally speaking, it is desirable to have as high of concentration of gelatin in the ungelled gelatin solution as possible so that the maximum amount of gelatin can be mixed into the flowing fluids in the shortest amount of time. In other words, the concentration of gelatin in said ungelled solution may be the maximum amount which will allow the solution to remain ungelled at said the temperature of the flowing fluids. However, in some instances, it may be more practical from an economic or safety consideration to adjust the gelatin concentration in relation to the actual line temperature of the pipeline being treated. Referring now to FIG. 4, it can be seen that as the concentration of gelatin in a solution increases, the temperature required to melt the gelatin (e.g. gelling temperature) also increases. For example, a solution having an 80% gelatin concentration by weight has a melting temperature—that which required to keep the solution substantially liquid—is approximately 170° F. Therefore, if an actual line temperature is only 120° F., it may be more economical to use a concentration of only about 50% gelatin rather than expend the energy necessary to raise the line temperature above its normally-existing temperature.

Further by way of example, a typical solution for use in a pipeline having a line temperature of 125° F. would be approximately 55% of technical gelatin by weight and 45% of liquid by weight (water, treating solution, and, if desired, anti-freeze material). The solution would be heated to and maintained at at least 125° F. or higher until it is mixed with the fluids flowing through the pipeline. Mixing can be accomplished by merely injecting (e.g. pumping) the solution directly into the flowing fluids in the pipelines through a simple inlet in the line. The solution mixes with the flowing fluids and will remain in as a liquid due to the line temperature which is above the melting temperature of the gelatin.

The temperature of the solution stretches the ungelled molecules of the ungelled gelatin and will migrate along with any entrained treating solution outward onto the wall of the pipeline where they form a treatment layer.

What is claimed is:

1. A method for treating a tubular having fluids flowing therethrough which, in turn, have a temperature above the melting temperature of gelatin, said method comprising:

mixing a gelatin solution with said flowing fluids in said tubular, said gelatin solution comprising:

an ungelled solution of technical gelatin derived from collagen and used in foods and glues, said ungelled gelatin solution having a temperature of not less than the temperature of said fluids flowing in said tubular whereby said said gelatin solution remains ungelled after mixing with said flowing fluids.

2. The method of claim 1 wherein said solution comprises water.

3. The method of claim 2 wherein said solution includes an anti-freeze material.

4. The method of claim 3 wherein said anti-freeze material is methanol.

5. The method of claim 1 wherein said solution includes:

a treating solution.

6. The method of claim 5 wherein said treating solution comprises:

a corrosion inhibitor.

7. The method of claim 5 wherein said treating solution comprises:

a drag reducer.

8. The method of claim 1 wherein the concentration of gelatin in said ungelled solution is the maximum amount which will allow the solution to remain ungelled at said the temperature of the flowing fluids.

9. The method of claim 8 wherein said concentration is from about 30% to about 90% by weight.

* * * * *